US009995140B2

(12) United States Patent
Faulkner et al.

(10) Patent No.: US 9,995,140 B2
(45) Date of Patent: Jun. 12, 2018

(54) YIELDABLE PROP WITH YIELDABLE INSERT

(71) Applicant: FCI Holdings Delaware, Inc., Wilmington, DE (US)

(72) Inventors: Dakota Faulkner, New Kensington, PA (US); Thomas Cook, Washington, PA (US); John G. Oldsen, Butler, PA (US); John C. Stankus, Canonsburg, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 17 days.

(21) Appl. No.: 14/479,419

(22) Filed: Sep. 8, 2014

(65) Prior Publication Data

US 2015/0147122 A1 May 28, 2015

Related U.S. Application Data

(60) Provisional application No. 61/907,564, filed on Nov. 22, 2013.

(51) Int. Cl.
*E21D 15/14* (2006.01)
*E21D 15/55* (2006.01)
*E21D 15/18* (2006.01)

(52) U.S. Cl.
CPC ..... *E21D 15/55* (2013.01); *E21D 15/18* (2013.01)

(58) Field of Classification Search
CPC ..... E21D 15/14; E21D 15/02; E21D 15/04; E21D 15/24; E21D 15/50; E21D 15/502; E21D 15/55
USPC ..... 405/288, 290, 291, 292, 293, 294, 302.1
See application file for complete search history.

(56) References Cited

U.S. PATENT DOCUMENTS 332,141 A * 12/1885 Donaldson ..... 52/146
416,901 A * 12/1889 Clark ..... G09F 17/00 116/173
681,326 A * 8/1901 Kinnear ..... E06B 3/44 49/428
737,133 A * 8/1903 O'Brien ..... E21D 15/54 248/357
844,385 A * 2/1907 Mommertz ..... E04G 11/56 248/354.1
881,006 A * 3/1908 Kline ..... A63H 33/04 116/173
881,609 A * 3/1908 Nellen ..... E21D 15/18 248/354.2
969,851 A * 9/1910 Eickershoff ..... E21D 15/18 248/354.2
987,397 A * 3/1911 Pittroff ..... 248/351
(Continued)

OTHER PUBLICATIONS

"Sand Prop™" product brochure, Strata Worldwide, http://www.strataworldwide.com/sites/default/files/products//brochure/StrataSandProp.pdf, 2 pages (undated).

*Primary Examiner* — Benjamin F Fiorello
*Assistant Examiner* — Edwin J Toledo-Duran
(74) *Attorney, Agent, or Firm* — The Webb Law Firm

(57) ABSTRACT

A mine prop includes a first pipe having a first end and a second end, a second pipe having a first end and a second end, and a yield member secured to the second pipe. The second pipe is slidably received in the first pipe. The yield member is configured to yield before the first and second pipes when the mine prop is placed under a predetermined load.

24 Claims, 10 Drawing Sheets

(56) References Cited

U.S. PATENT DOCUMENTS 1,006,163 A * 10/1911 Winz ..... E01F 9/635 123/70 V
1,049,135 A * 12/1912 Nellen ..... E21D 15/18 248/354.2
1,445,625 A * 2/1923 Junkunc ..... A47G 33/1206 248/523
1,628,645 A * 5/1927 Andrews ..... E04H 17/08 256/1
1,631,227 A * 6/1927 See ..... E04H 12/2246 211/196
1,690,311 A * 11/1928 Reich ..... A47K 1/09 206/362.3
1,752,101 A * 3/1930 Meutsch ..... E21D 15/445 248/354.1
1,765,200 A * 6/1930 Bullough ..... E21D 15/18 213/1 A
1,805,095 A * 5/1931 Horni ..... E01F 9/688 248/523
1,890,423 A * 12/1932 Teagarden ..... F41A 23/00 248/354.6
1,895,053 A * 1/1933 Staley ..... E21D 15/18 248/354.2
2,029,789 A * 2/1936 Parks ..... E21D 15/18 213/1 A
2,036,490 A * 4/1936 Neilson ..... E21D 11/183 248/548
2,175,777 A * 10/1939 Knight ..... E21D 15/18 248/354.2
2,302,237 A * 11/1942 McFall ..... A47G 25/56 248/161
2,390,267 A * 12/1945 Pearce ..... A63C 11/221 248/354.1
2,437,510 A * 3/1948 Ditty ..... F16B 7/105 403/105
2,456,330 A * 12/1948 Scott ..... H01Q 21/10 343/901
2,510,688 A * 6/1950 Evans ..... B23Q 3/105 248/354.2
2,516,802 A * 7/1950 Richards ..... A47G 33/12 248/523
2,532,168 A * 11/1950 Jakoubek ..... E21D 15/24 248/354.3
2,544,780 A * 3/1951 Dean ..... B66F 3/08 248/354.3
2,645,315 A * 7/1953 Frushour ..... E04H 12/182 29/467
2,706,004 A * 4/1955 Katzenmaier ..... E21B 41/00 166/75.11
2,745,622 A * 5/1956 Zindel ..... E21D 15/285 248/354.1
2,787,484 A * 4/1957 Macy ..... A01K 87/025 138/125
2,841,634 A * 7/1958 Kimball ..... E04H 12/182 174/45 R
2,928,633 A * 3/1960 Holmes ..... A47G 33/12 248/523
2,928,643 A * 3/1960 Bellmann ..... E21D 15/306 248/354.1
3,119,588 A * 1/1964 Keats ..... E01F 13/02 116/173
3,280,527 A * 10/1966 Faust ..... E04B 2/822 108/106
3,318,560 A * 5/1967 Garrette, Jr. ..... E04H 12/182 248/156
3,353,852 A * 11/1967 Wood ..... B62D 27/04 248/511
3,417,732 A * 12/1968 Platt, Jr. ..... G09F 17/00 116/173
3,495,370 A * 2/1970 Habro ..... B21C 37/151 52/118
3,538,785 A * 11/1970 Grancon ..... B62D 1/192 188/371
3,587,520 A * 6/1971 Habro ..... E04H 12/32 116/173
3,602,471 A * 8/1971 Reed, III ..... B64D 1/02 248/156
3,648,960 A * 3/1972 Krekeler ..... E21D 15/18 248/354.2
3,737,134 A * 6/1973 Foon ..... E04G 25/08 248/354.3
3,793,794 A * 2/1974 Archer ..... E04H 12/12 52/115
3,836,174 A * 9/1974 Holman, Jr. ..... B60P 7/15 211/105.6
3,877,319 A * 4/1975 Cooper ..... B62D 1/192 188/371
3,994,467 A * 11/1976 Pike ..... E21D 15/22 188/372
4,006,647 A * 2/1977 Oonuma ..... B62D 1/192 188/371
4,167,361 A * 9/1979 Petro ..... E21D 15/44 248/354.2
4,185,940 A * 1/1980 Spies ..... E21D 15/02 248/354.1
4,192,479 A * 3/1980 Friebe ..... E21D 15/007 248/354.1
4,249,837 A * 2/1981 Spies ..... E21D 15/005 248/354.1
4,255,071 A * 3/1981 Koppers ..... E21D 15/02 248/354.1
4,344,719 A * 8/1982 Thom ..... E04F 11/1817 403/297
4,382,721 A * 5/1983 King ..... E21D 15/22 248/548
4,433,515 A * 2/1984 Mentzer ..... B66C 23/708 212/292
4,513,938 A * 4/1985 Seymour ..... B65F 1/141 211/1.3
4,517,775 A * 5/1985 Engel ..... B65F 1/141 248/907
4,576,354 A * 3/1986 Blessing, Sr. ..... E04F 21/1805 182/186.6
4,899,499 A * 2/1990 Hoekstra ..... E01F 13/028 403/78
4,907,835 A * 3/1990 Salters ..... B60N 2/787 296/1.09
4,918,896 A * 4/1990 Wiese ..... E04H 12/182 52/632
4,928,916 A * 5/1990 Molloy ..... E04F 21/1805 248/354.1
5,015,125 A * 5/1991 Seegmiller ..... E21D 15/38 248/354.1
5,035,094 A * 7/1991 Legare ..... B63B 15/0083 343/903
5,056,753 A * 10/1991 Lunau ..... A47K 17/02 248/200.1
5,169,111 A * 12/1992 Dunaj ..... A45B 25/24 248/523
5,215,411 A * 6/1993 Seegmiller ..... E21D 15/38 248/354.1
5,228,810 A * 7/1993 Seegmiller ..... E21D 15/42 248/354.3
5,308,280 A * 5/1994 Dotson ..... E21F 1/14 160/368.1
5,354,031 A * 10/1994 Bilotti ..... E04H 12/2238 248/511
5,400,994 A * 3/1995 Shawwaf ..... E21D 15/22 248/354.3
5,413,436 A * 5/1995 Merz ..... E21D 15/18 248/354.2
5,460,353 A * 10/1995 Rittenhouse ..... A63B 71/028 160/135
5,476,284 A * 12/1995 Durocher ..... B62D 1/192 188/371
5,484,130 A * 1/1996 Domanski ..... E21D 15/24 248/354.3
5,538,364 A * 7/1996 Huntsman ..... E21D 15/54 405/288

(56) References Cited

U.S. PATENT DOCUMENTS 5,540,017 A * 7/1996 Eilam ..... B64G 1/222 248/188.5
5,564,867 A * 10/1996 Domanski ..... E21D 15/325 248/354.3
5,583,288 A * 12/1996 Brenner ..... B60C 23/00 248/354.5
5,639,056 A * 6/1997 Mecalf ..... A47B 91/00 248/163.1
5,826,847 A * 10/1998 Warner ..... F16B 7/1463 248/354.1
5,921,718 A * 7/1999 Kolk ..... E21D 15/18 248/354.2
5,924,469 A * 7/1999 Whittemore ..... A47H 21/00 160/351
6,056,480 A * 5/2000 Kolk ..... E21D 15/18 248/354.2
6,073,642 A * 6/2000 Huang ..... A45B 9/00 135/114
6,158,706 A * 12/2000 Johnson ..... E04G 25/06 248/188.4
6,273,112 B1 * 8/2001 Sumida ..... A45B 9/00 135/69
6,409,139 B1 * 6/2002 Du Pree ..... A47B 61/003 248/354.1
6,464,192 B1 * 10/2002 Gibbs, Jr. ..... B66F 1/025 248/352
6,481,052 B1 * 11/2002 Beall ..... E05C 17/54 16/422
6,536,990 B2 * 3/2003 Schubert ..... B60R 19/34 248/351
6,571,426 B2 * 6/2003 Chen ..... A47B 61/003 16/87 R
6,655,877 B2 * 12/2003 Calhoun ..... E21D 15/22 248/542
6,910,834 B2 * 6/2005 Harbaugh et al. ..... 405/288
7,134,810 B2 * 11/2006 Stankus ..... E21D 15/40 248/354.1
7,255,312 B2 * 8/2007 Melic ..... E04G 21/3233 248/125.1
7,472,522 B2 * 1/2009 Yang ..... E04C 5/161 52/301
7,484,696 B2 * 2/2009 Kim ..... E04G 21/185 138/89
7,503,731 B2 * 3/2009 Seegmiller ..... E21D 15/22 405/288
7,506,775 B2 * 3/2009 Hartzell ..... E04H 12/2253 211/107
7,600,734 B2 * 10/2009 Clarke ..... A45B 25/00 135/120.3
7,914,238 B2 * 3/2011 Spearing ..... E21D 15/43 405/288
8,052,352 B2 * 11/2011 Bolton ..... E21D 15/24 248/351
8,117,787 B2 * 2/2012 Lee ..... E04G 25/06 248/354.1
8,152,118 B2 * 4/2012 Melic ..... E04G 21/3233 248/161
8,215,241 B2 * 7/2012 Garneau ..... A47B 9/20 108/147
8,628,064 B2 * 1/2014 Wu ..... A45C 13/262 248/125.8
8,821,075 B2 * 9/2014 McCartney ..... E21D 15/28 405/288
8,851,805 B2 * 10/2014 Shook ..... E21D 15/18 248/354.2
2002/0040956 A1 * 4/2002 Carnahan ..... B63B 29/06 248/188.8
2002/0113190 A1 * 8/2002 Berthiaume ..... E04H 12/2269 248/523
2003/0001066 A1 * 1/2003 Chen ..... A47C 3/26 248/511
2004/0223815 A1 * 11/2004 Stankus ..... E21D 15/325 405/288
2005/0247414 A1 * 11/2005 Whittemore ..... E04G 21/24 160/351
2006/0133899 A1 * 6/2006 Seegmiller ..... E21D 15/22 405/290
2007/0267559 A1 * 11/2007 Spearing ..... E21D 15/43 248/354.1
2008/0315062 A1 * 12/2008 Salman ..... E01F 9/681 248/519
2011/0262231 A1 * 10/2011 Hussey ..... E21D 15/483 405/289
2012/0049034 A1 * 3/2012 Whittemore ..... E04G 21/24 248/354.1
2013/0108376 A1 * 5/2013 McCartney ..... E21D 15/28 405/290
2013/0146736 A1 * 6/2013 Wheeler ..... E05C 17/30 248/354.1
2013/0153737 A1 * 6/2013 Zoeteman ..... A45B 23/00 248/513

* cited by examiner

YIELDABLE PROP WITH YIELDABLE INSERT

CROSS REFERENCE TO RELATED APPLICATION

This application claims the benefit of U.S. Provisional Application No. 61/907,564, filed Nov. 22, 2013, the disclosure of which is hereby incorporated in its entirety by reference.

BACKGROUND OF THE INVENTION

Field of the Invention

This invention is related to a mine roof support and, more particularly, to a yieldable prop with a yieldable insert.

Description of Related Art

Mine roof supports are used in underground mining operations to support the rock strata that define the underground opening. One type of mine prop, typically referred to as a sand prop, utilizes two steel pipes with one nested inside the other. The inner pipe is filled with "sand", particulate matter such as ceramic beads having a 0.050 inch diameter, and includes a steel washer at the bottom of the pipe. The two pipes utilize a telescoping arrangement to extend between the roof and floor of the mine opening. When the inner pipe is moved upwardly relative to the outer pipe, the sand flows from the inner pipe and through a hole in the steel washer into the outer pipe, which sets the height of the prop and creates a load bearing structure. This type of sand prop arrangement is typically rated for 30, 60, or 100 tons. Under loading, these conventional sand props typically begin to buckle and fail after approximately 1.5-2 inches of displacement.

Another type of sand prop, which utilizes a similar telescoping arrangement, is yieldable by deforming the outer pipe when placed under a predetermined load. This allows the sand prop to maintain a certain load while undergoing displacement.

Other types of mine roof props are yieldable by using an arrangement having an inner conduit slidably mounted into an outer conduit and held in position by a clamp assembly. As a compression load, e.g., a shifting mine roof, acts on the prop, the first tube slides into the second tube. The force of the clamp assembly typically controls the load that the prop can take before it compresses.

SUMMARY OF THE INVENTION

In one embodiment, a mine prop includes a first pipe having a first end and a second end, a second pipe having a first end and a second end, and a yield member secured to the second pipe. The second pipe is slidably received in the first pipe. The yield member is configured to yield before the first and second pipes when the mine prop is placed under a predetermined load.

The yield member may include a body having a first end and a second end with the body of the yield member defining at least one passageway extending between the first and second ends of the body. The yield member may be secured to the second end of the second pipe. The first end of the body of the yield member may define an annular recess with the first end of the body of the yield member secured to the second end of the second pipe via a friction fit. The annular recess may define a tapered portion on an outer surface of the yield member. The tapered portion may extend outwardly from a first end of the yield member to the annular recess. A washer may be secured to the second end of the second pipe with the washer defining an opening. The yield member is secured to the washer with the at least one passageway of the yield member in fluid communication with the opening of the washer. The yield member may comprise a polymeric material. The mine prop may further include particulate matter received within the second pipe and the at least one passageway of the yield member with the second pipe having a retracted position and an extended position relative to the first pipe. The particulate matter is movable from the second pipe to the first pipe when the second pipe transitions from the retracted position to the extended position. A secondary yielding arrangement may be provided that is configured to yield prior to the yield member yielding. The secondary yielding arrangement may include a yieldable plate having a concave side facing away from the first end of the second pipe.

In a further embodiment, a method of supporting a mine roof includes positioning a mine prop within a mine opening, where the mine prop includes a first pipe having first and second ends, a second pipe having first and second ends, and a yield member secured to the second pipe. The second pipe is received in the first pipe. The method further includes extending the second pipe towards a roof of the mine opening, and plastically deforming the yield member when the mine prop receives a predetermined load from the roof of the mine opening.

The mine prop may further include particulate matter positioned within the second pipe with the particulate matter moving from the second pipe to the first pipe when extending the second pipe toward the roof of the mine opening.

In another embodiment, a mine prop includes a first pipe having a first end and a second end, a second pipe having a first end and a second end, a centering pipe received by the first end of the second pipe, and a yield pipe having a first end and a second end. The second pipe is slidably received in the first pipe. The yield pipe receives the centering pipe with the second end of the yield pipe engaging the first end of the second pipe. The yield pipe is configured to yield before the second pipe when the mine prop is placed under a predetermined load.

The mine prop may include a washer positioned adjacent the second end of the second pipe with the washer defining an opening. The mine prop may include particulate matter positioned within the second pipe with the second pipe having a retracted position and an extended position relative to the first pipe. The particulate matter is movable from the second pipe to the first pipe when the second pipe transitions from the retracted position to the extended position. The yield pipe may be axially aligned with the second pipe. The yield pipe may have a lower compressive strength than a compressive strength of the second pipe. The mine prop may further include first and second support plates with the first support plate secured to the first end of the yield pipe and the second support plate secured to the second end of the first pipe.

In yet another embodiment, a mine prop includes a first pipe having a first end and a second end, a second pipe having a first end and a second end, a washer received within the second pipe and defining at least one passageway, and particulate matter positioned within the second pipe with the second pipe having a retracted position and an extended position relative to the first pipe. The second pipe is slidably received in the first pipe and the washer comprises a polymeric material. The particulate matter is movable from the second pipe to the first pipe when the second pipe transitions from the retracted position to the extended position.

The washer may comprise polyvinyl chloride and the washer may be secured to the second pipe via a friction fit. The at least one passageway of the washer may include at least four passageways.

DESCRIPTION OF THE INVENTION

Figure 1:
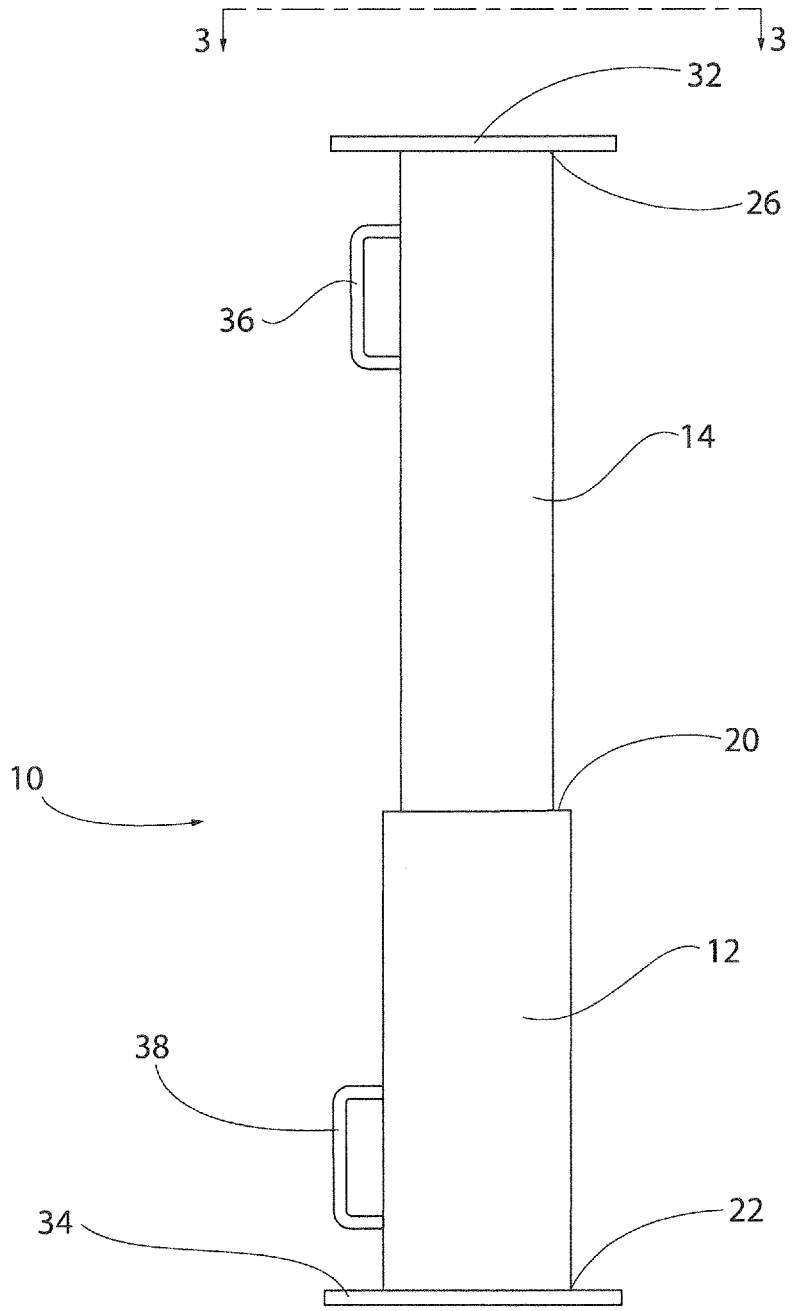
FIG. 1 is an elevation view of a mine roof prop according to one embodiment of the present invention.

The present invention will now be described with reference to the accompanying figures. For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is to be understood that the specific apparatus illustrated in the attached figures and described in the following specification is simply an exemplary embodiment of the present invention. Hence, specific dimensions and other physical characteristics related to the embodiments disclosed herein are not to be considered as limiting.

Figure 2:
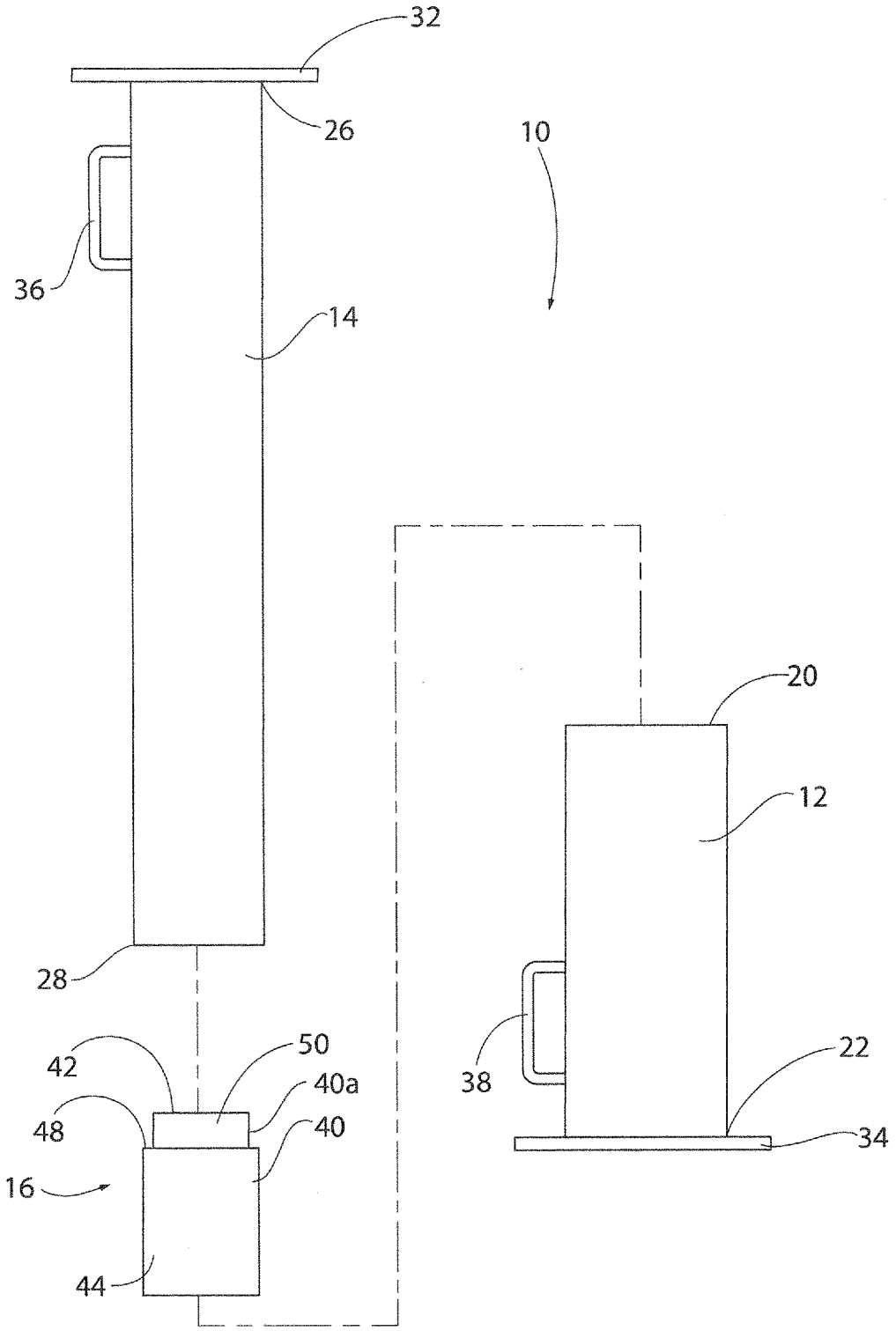
FIG. 2 is an exploded front view of the mine roof prop shown in FIG. 1.
Figure 3:
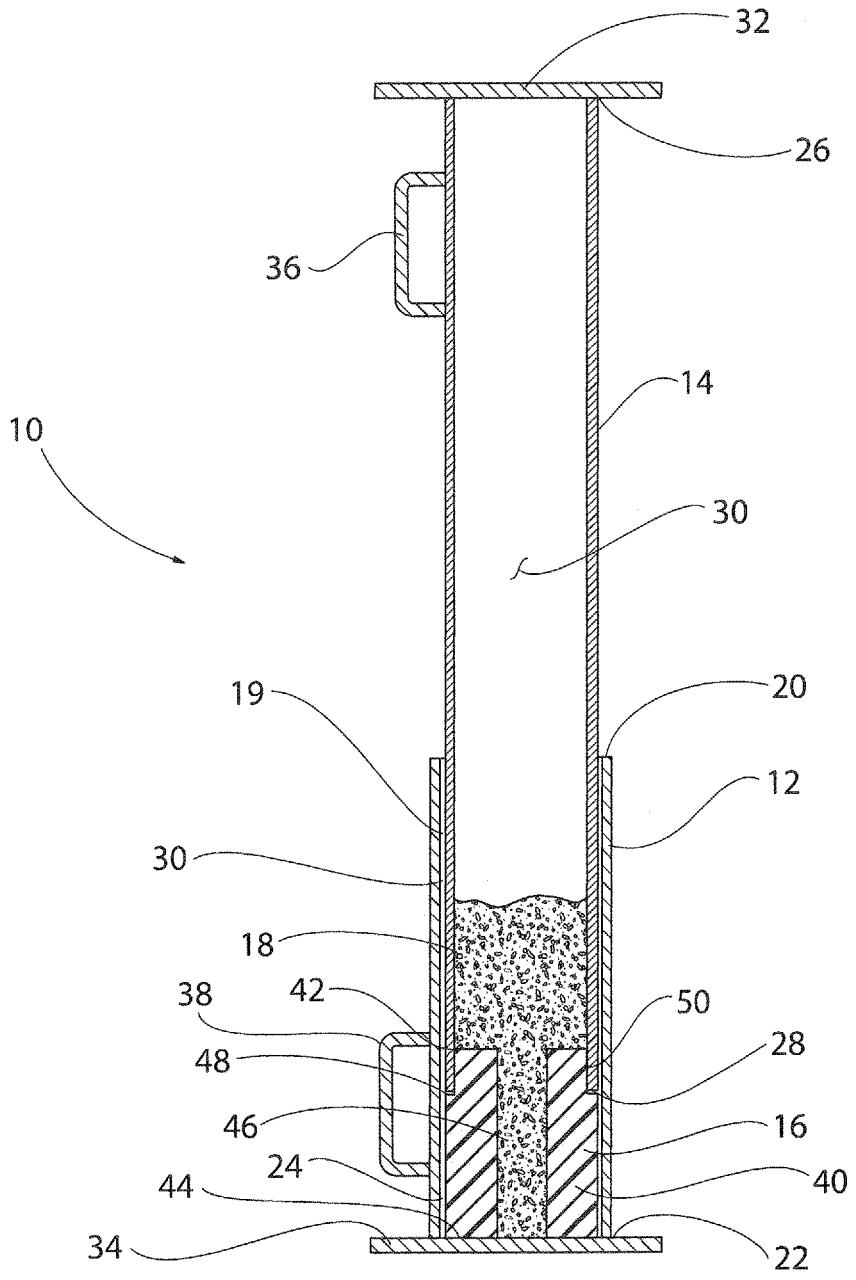
FIG. 3 is a cross-sectional view of the mine roof prop shown in FIG. 1 along line 3-3.

Referring to FIGS. 1-3, one embodiment of a mine roof prop 10 includes a first pipe 12, a second pipe 14, a yield member 16, and particulate matter 18. The first pipe 12 has a first end 20 and a second end 22 and defines a central passageway 24. The second pipe 14 also has a first end 26 and a second end 28 and defines a central passageway 30. The second pipe 14 is slidably received within the first pipe 12 to allow the second pipe 14 to move or telescope outwardly from or away from the first pipe 12. The first pipe 12 and the second pipe 14 may be cylindrical in shape. It is also contemplated, however, that alternative shapes may be used, such as oval, triangular, or trapezoidal-shaped. A first support plate 32 is secured to the first end 26 of the second pipe 14 and a second support plate 34 is secured to the second end 22 of the first pipe 12. The first support plate 32 closes one end of the central passageway 30 of the second pipe 14 and the second support plate 34 closes one end of the central passageway 24 of the first pipe 12. Further, a first handle 36 is secured to the second pipe 14 between the first and second ends 26, 28 of the second pipe 14. A second handle 38 is secured to the first pipe 12 between the first and second ends 20, 22 of the first pipe 12.

Figure 12:
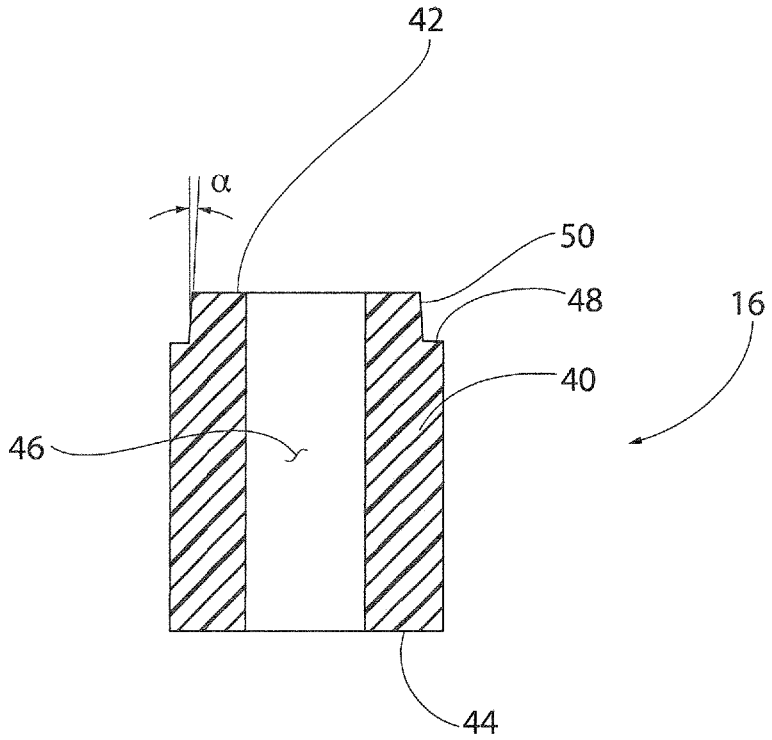
FIG. 12 is a cross-sectional view of a yield member according to another embodiment of the present invention.

The yield member 16 includes a main body 40 and a narrower portion 40*a*, with a first end 42 and second end 44. The cross-sectional shape of the main body 40 generally corresponds to the cross-sectional shape of the first pipe 12 and the second pipe 14. In one embodiment, at least a portion of the yield member 16 may have a substantially cylindrical cross-sectional shape to correspond to the cross-sectional shape of the first pipe 12 and the second pipe 14. The yield member 16 defines a passageway 46 that extends from the first end 42 to the second end 44 thereof. The narrower portion 40*a* of the yield member 16 thereby defines an annular recess 48, extending around the outer circumferential surface of the yield member 16. As shown in FIG. 12, the outer surface 50 of the narrower portion 40*a* may be slightly tapered. The diameter of the outer surface 50 may increase from the first end 42 of the narrower portion 40*a* to the main body 40, as shown by angle $\alpha$ in FIG. 12. The taper may also be defined by a difference between the outer diameter of the first end 42 of the narrower portion 40*a* and the inner diameter of the second pipe 14. In one embodiment, the difference between the outer diameter of the first end 42 of the narrower portion 40*a* and the inner diameter of the second pipe 14 may be approximately 0.008 inch, including 0.008 inch, but other dimensions may be used such as in the range of 0.001 to 0.01 inch. The taper provides for easy insertion of the first end 42 of the yield member 16 into the second pipe 14. It should be appreciated that in other embodiments, the outer surface 50 may not be tapered, yet the yield member 16 without a tapered surface 50 may also be sized for insertion into the second pipe 14.

The first end 42 of the narrower portion 40*a* of the yield member 16 is secured to the second end 28 of the second pipe 14 with the passageway 46 of the main body 40 in fluid communication with the central passageways 24, 30 of the first and second pipes 12, 14. The outer diameter of the main body 40 of the yield member 16 may generally match the outer diameter of the second pipe 14. The narrower portion 40*a* of the yield member 16 is configured to be received within the central passageway 30 of the second pipe 14. By providing a taper on the surface 50, the yield member 16 may be readily inserted into the central passageway 30 of the second pipe 14. A secure connection between the second end 28 of the second pipe 14 and the yield member 16 may be achieved by friction or interference fit, welding, adhesive, or fastening members, among other methods of connection. The yield member 16 may be manufactured from a polymeric material, such as high-density polyethylene (HDPE), although other suitable materials may be utilized. For example, other thermoplastic materials, such as polyvinyl chloride (PVC), may be utilized to achieve a desired amount of yielding as discussed below in more detail. Further, other types of materials, such as wood or air entrained cements, may be utilized provided that the yield member 16 enables the yielding or displacement between the first and second pipes 12, 14 as discussed below.

Referring to FIG. 3, prior to installation, the particulate matter 18 is received within the central passageway 30 of the second pipe 14 and the passageway 46 of the yield member 16. As discussed below, the second pipe 14 may be received in a retracted position and an extended position relative to the first pipe 12. The particulate matter 18 is configured to move or flow from the second pipe 14 into the first pipe 12 when the second pipe 14 is transitioned from the retracted position to the extended position. The particulate matter (also referred to as "sand") may be a proppant, such as ceramic beads having a 0.050 inch diameter, although other suitable materials may be utilized.

Figure 4:
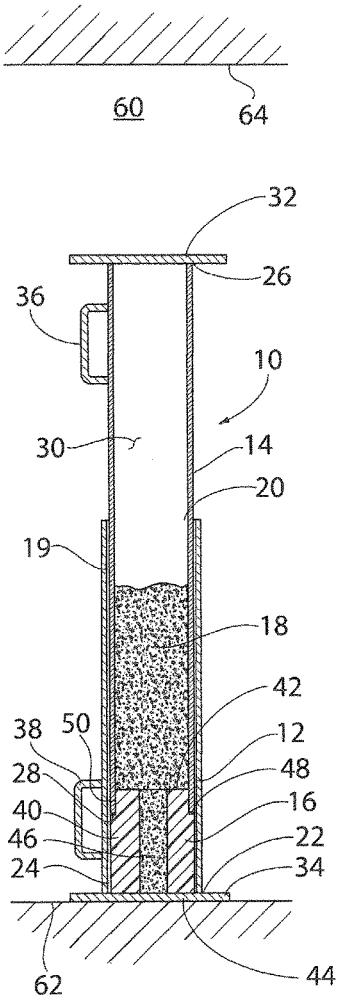
FIG. 4 is a cross-sectional view of the mine roof prop shown in FIG. 1 with the mine roof prop in a retracted position during installation along line 3-3.
Figure 5:
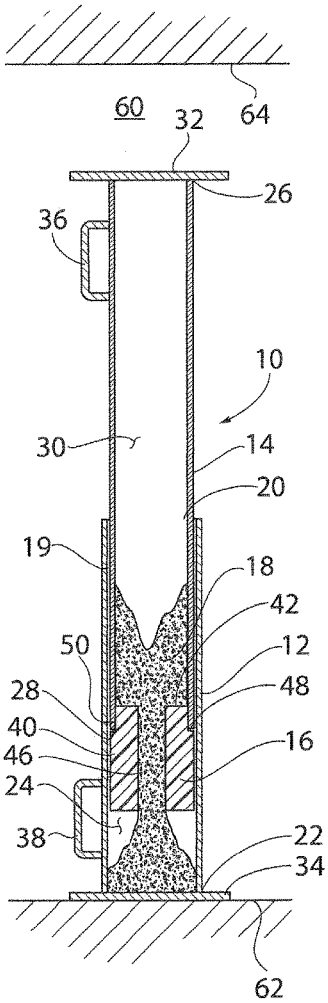
FIG. 5 is a cross-sectional view of the mine roof prop shown in FIG. 1 with the mine roof prop in an intermediate position during installation along line 3-3.
Figure 6:
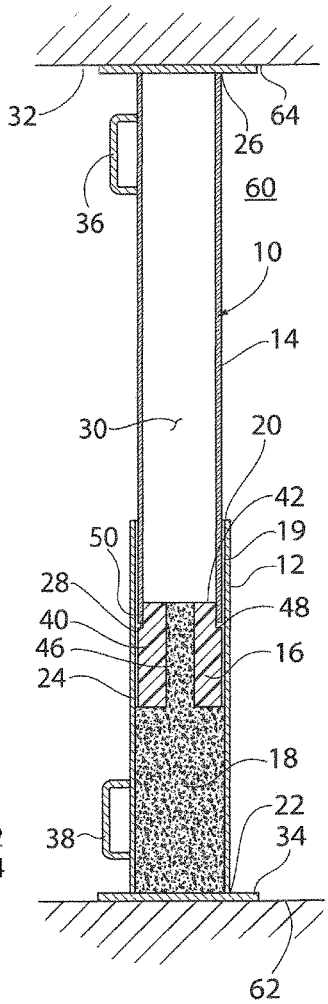
FIG. 6 is a cross-sectional view of the mine roof prop shown in FIG. 1 with the mine roof prop in an extended position during installation along line 3-3.

Referring to FIGS. 4-6, the installation of the mine roof prop 10 within a mine opening 60 is shown. The mine roof prop 10 is initially positioned within the mine opening 60 with the second pipe 14 in a retracted position, as shown in FIG. 4, and the second support plate 34 engaging a floor 62 of the mine opening 60. In the retracted position, the yield member 16 may rest on the second plate 34. The second pipe 14 is transitioned from the retracted position to the extended position by moving the second pipe 14 upwardly relative to the first pipe 12 toward a roof 64 of the mine opening 60. The first handle 36 may be used to move the second pipe 14 towards the roof 64 of the mine opening 60, relative to the first pipe 12. As shown in FIG. 5, as the second pipe 14 is transitioned to the extended position, the particulate matter 18 positioned within the central passageway 30 of the second pipe 14 and the passageway 46 of the yield member 16 moves or flows from the second pipe 14, through the passageway 46 of the yield member 16, and into the first pipe 12. The second pipe 14 is moved upward until the first plate 32 engages the roof 64 of the mine opening 60 as shown in FIG. 6. The particulate matter 18 flows into the first pipe 12 through the yield member 16 to set the height of the prop 10 and to create a load bearing surface on which the yield member 16 may rest.

Upon receiving a predetermined load, the yield member 16 will yield to allow relative movement between the first and second pipes 12, 14. The yield member 16 is configured to yield before the first and second pipes 12, 14. In one embodiment, when the mine roof prop 10 is placed under a predetermined load, the yield member 16 will plastically deform with a portion of the yield member 16 being extruded through the annular gap 19 between the first and second pipes 12, 14 and/or back up into the central passageway 30 of the second pipe 14. The mine roof prop 10 may be designed to yield until a desired and predetermined peak load is reached. The displacement or yielding of the mine roof prop 10 will vary based on the physical properties of the yield member 16 and the second pipe 14, such as the compressive strength, lubricity, and dimensional shape of the yield member 16 and the yield strength, tensile strength, and edge shape of the pipe 14. In certain embodiments, the yielding of the yield member 16 is at least in part determined by the longitudinal length of the yield member 16. For example, if the longitudinal length of the yield member 16 is 3 inches, the yielding zone of the prop 10 will be approximately 3 inches. The longitudinal length of the yield member 16, the material used for the yield member 16, and the shape and dimensions of the yield member 16 may be optimized to provide a desired amount of yielding at certain loads. In one embodiment, the longitudinal length of the yield member 16 measured from the first end 42 of the narrower portion 40*a* to the second end 44 of the main body 40 is 4 inches. In a further embodiment, the longitudinal length of the yield member 16 measured from the first end 42 of the narrower portion 40*a* to the second end 44 of the main body 40 is about 8-12 inches and may be manufactured from PVC.

The mine roof prop 10 may be rated for a load of 30, 60, or 100 tons, although the prop 10 may be designed for additional load ratings as well. When rated for 30 tons, the mine roof prop 10 may begin yielding at approximately 20 tons and yield to achieve approximately 4 inches of displacement with a yield member 16 that has a longitudinal length of 4 inches. When rated for 60 tons, the mine roof prop 10 may begin yielding at approximately 30 tons and yield to achieve approximately 4 inches of displacement with a yield member 16 that has a longitudinal length of 4 inches. Mine roof props rated for 30 tons and 60 tons will have a peak load of approximately 30 tons and 60 tons, respectively. In contrast, conventional particulate matter props typically begin to buckle and fail after approximately 1.5-2 inches of displacement. Providing the ability for the prop to yield while still supporting the load from the roof of the mine opening is beneficial in certain mining environments that may experience dynamic loads during use of the mining environment.

Figure 7:
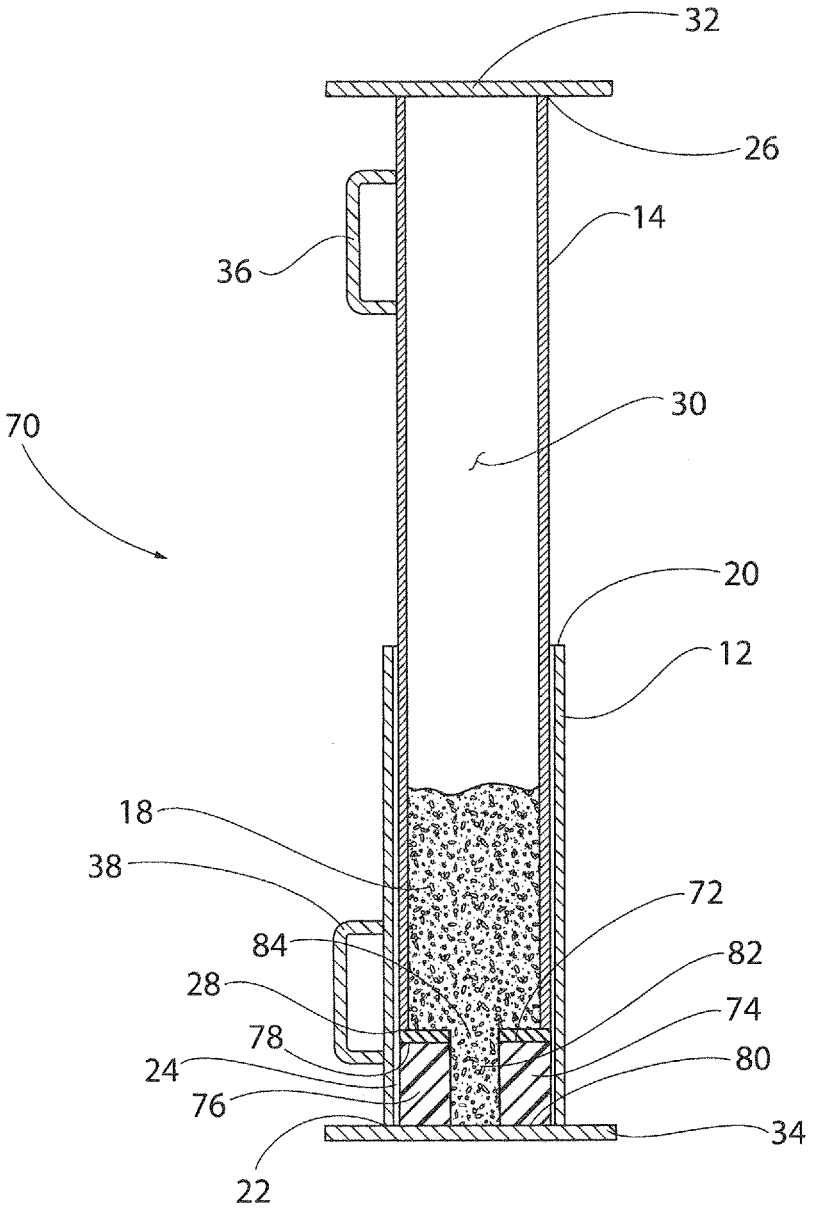
FIG. 7 is a cross-sectional view of a mine roof prop according to a second embodiment of the present invention.

Referring to FIG. 7, a second embodiment of a mine roof prop 70 is shown. The mine roof prop 70 is similar to the prop 10 described above and shown in FIGS. 1-6. A conventional particulate matter prop having a metal washer 72 may be modified by securing a yield member 74 to the existing washer 72. The yield member 74 includes a cylindrical body 76 having first and second ends 78, 80 and defining a passageway 82 extending between the first and second ends 78, 80. The passageway 82 of the yield member 74 is in fluid communication with a passageway 84 of the washer 72. The yield member 74 may be secured to the second pipe 14 and/or the washer 72 using any suitable arrangement, such as through the use of adhesives, friction welding, fasteners, etc. The mine roof prop 70 is installed and functions in a similar manner as described above in connection with the mine roof prop 10 shown in FIGS. 1-6.

Figure 8:
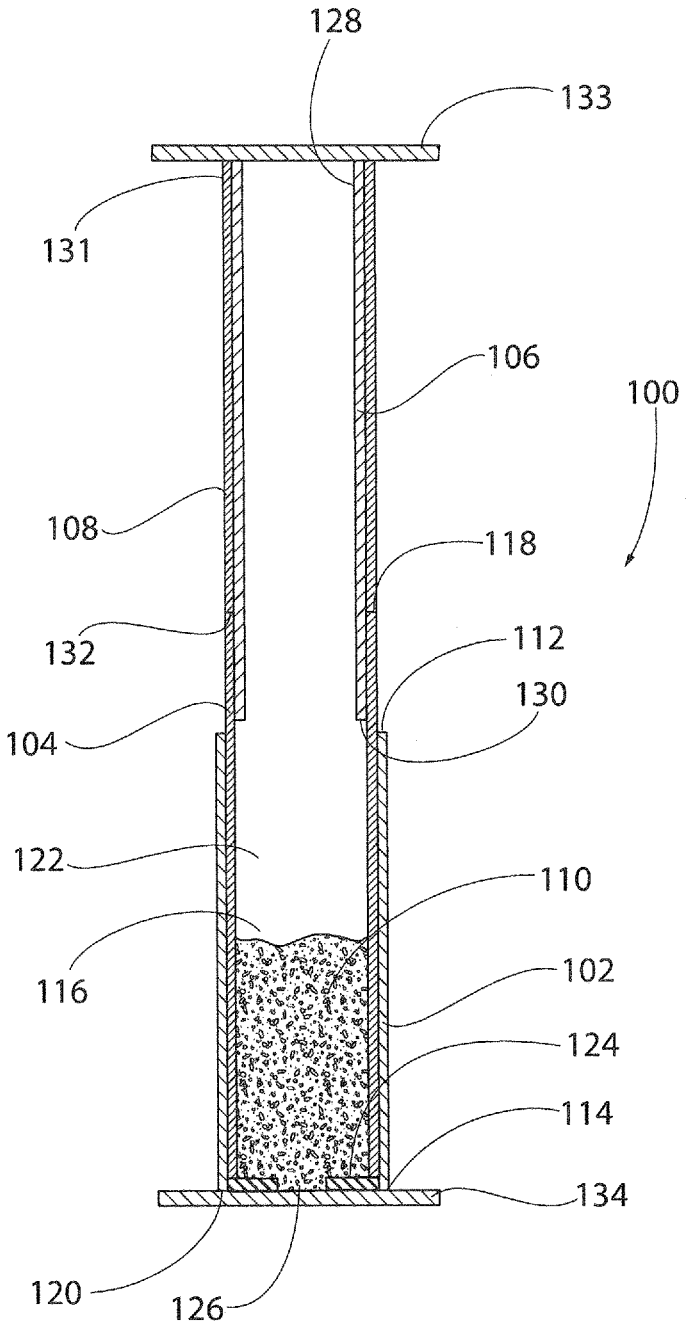
FIG. 8 is a cross-sectional view of a mine roof prop according to a third embodiment of the present invention.

Referring to FIG. 8, a third embodiment of a mine roof prop 100 is shown. The mine roof prop 100 includes a first pipe 102, a second pipe 104, a centering pipe 106, a yield pipe 108, and particulate matter 110. The first pipe 102 has a first end 112 and a second end 114 and defines a central passageway 116. The second pipe 104 includes a first end 118 and a second end 120 and defines a central passageway 122. The second pipe 104 is slidably received within the first pipe 102 to allow the second pipe 104 to move or telescope outwardly from the first pipe 102. A washer 124 defining an opening 126 is secured to the second end 120 of the second pipe 104. The washer 124 may be made from steel, although other suitable materials may be utilized. The centering pipe 106 has a first end 128 and a second end 130 that is received by the first end 118 of the second pipe 104. The yield pipe 108 has a first end 131 and a second end 132 and receives the centering pipe 106. A first support plate 133 is secured to the first end 131 of the yield pipe 108 and the first end 128 of the centering pipe 106. A second support plate 134 is secured to the second end 114 of the first pipe 102. The second end 132 of the yield pipe 108 engages the first end 118 of the second pipe 104 with the yield pipe 108 being axially aligned with the second pipe 104. The particulate matter 110 is positioned within the second pipe 104 and is movable from the second pipe 104 into the first pipe 102 when the second pipe 104 transitions from a retracted position to an extended position. The mine roof prop 100 is installed in a similar manner described above in connection with the mine roof prop 10 shown in FIGS. 1-6. The yield pipe 108 is configured to yield and plastically deform when the mine roof prop 100 is placed under a predetermined load. In particular, the yield pipe 108 is configured to yield before the second pipe 104 when the mine roof prop 100 is placed under a predetermined load to allow relative movement or displacement between the first and second support plates 133, 134. The yield pipe 108 has a lower compressive strength than a compressive strength of the second pipe 104.

Figure 9:
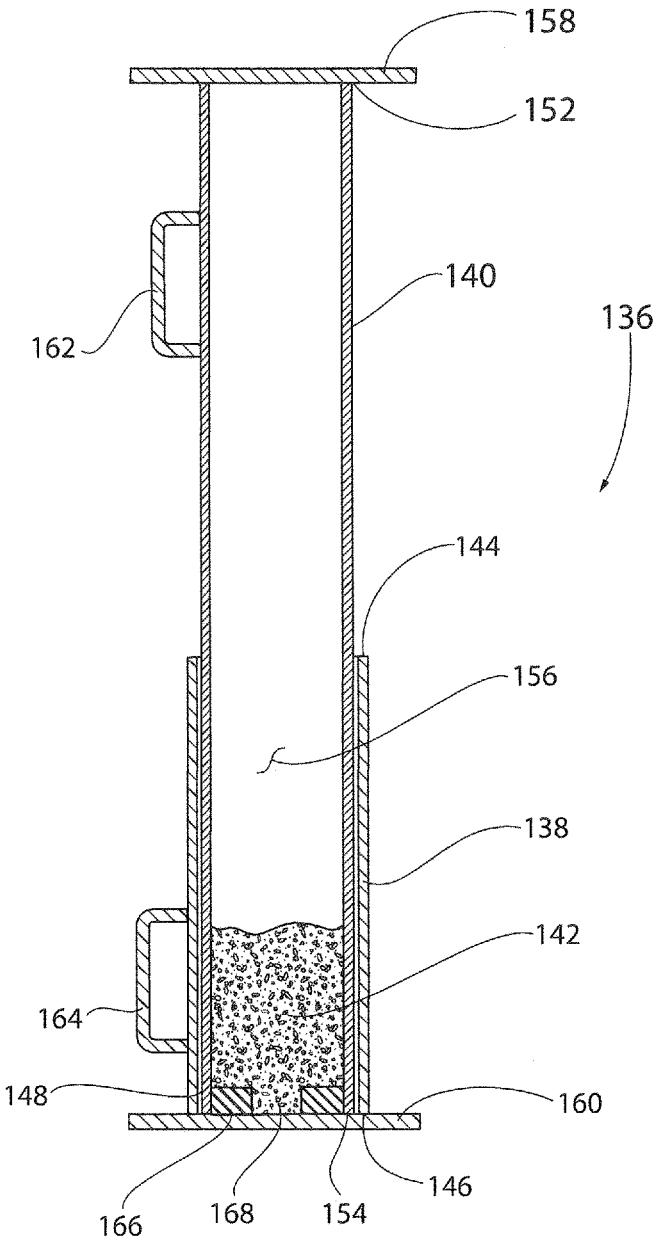
FIG. 9 is a cross-sectional view of a mine roof prop according to a fourth embodiment of the present invention.

Referring to FIG. 9, a fourth embodiment of a mine roof prop 136 is shown. The mine roof prop 136 includes a first pipe 138, a second pipe 140, and particulate matter 142. The first pipe 138 has a first end 144 and a second end 146 and defines a central passageway 148. The second pipe 140 has a first end 152 and a second end 154 and defines a central passageway 156. The second pipe 140 is slidably received within the first pipe 138 to allow the second pipe 140 to move or telescope outwardly from the first pipe 138. A first support plate 158 is secured to the first end 152 of the second pipe 140 and a second support plate 160 is secured to the second end 146 of the first pipe 138. The first support plate 158 closes one end of the central passageway 156 of the second pipe 140, and the second support plate 160 closes one end of the central passageway 148 of the first pipe 138. Further, a first handle 162 is secured to the second pipe 140 between the first and second ends 152, 154 of the second pipe 140. A second handle 164 is secured to the first pipe 138 between the first and second ends 144, 146 of the first pipe 138. A washer 166 is received within the passageway 156 of the second pipe 140. The particulate matter 142 is positioned within the second pipe 140 and is movable from the second pipe 140 to the first pipe 138 when the second pipe 140 transitions from a retracted position to an extended position. The washer 166 defines an opening 168 that is in fluid communication with the central passageways 148, 156 of the first and second pipes 138, 140. The washer 166 may be formed from polyvinyl chloride (PVC), although other suitable materials may be utilized. The washer 166 is secured within the second pipe 140 via a friction fit, although other suitable securing arrangements may be utilized. The mine roof prop 136 is less expensive to manufacture than conventional particulate matter props, which typically require a steel washer to be welded to the upper pipe. In contrast, the mine roof prop 136 shown in FIG. 9 utilizing a polymeric washer, which is easily installed by pressing or tapping the washer 166 into the second pipe 140 and secured within the second pipe 140 via a friction or interference fit, is simple to manufacture.

Figure 10:
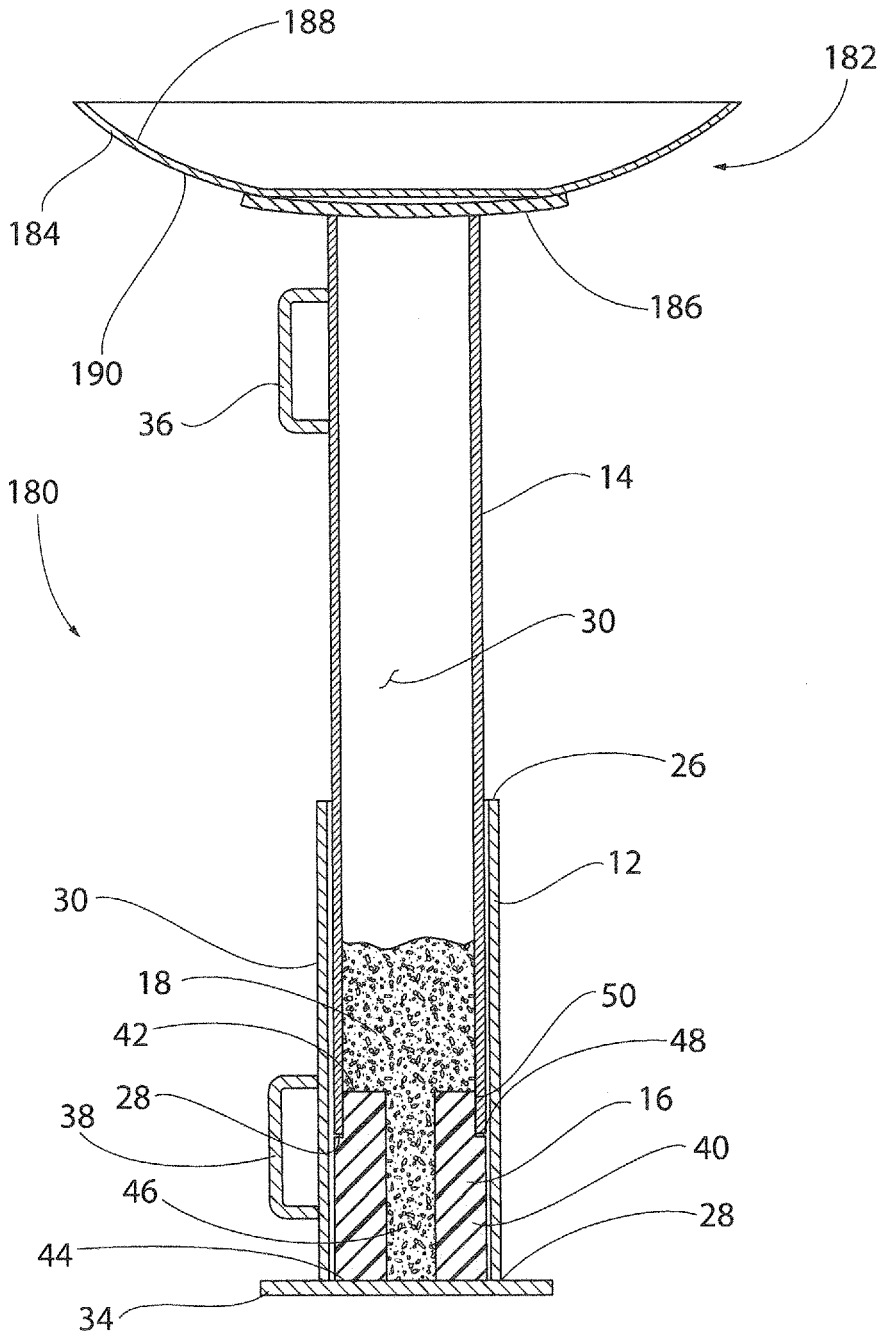
FIG. 10 is a cross-sectional view of a mine roof prop according to a further embodiment of the present invention.

Referring to FIG. 10, a further embodiment of a mine roof prop 180 is shown. The mine roof prop 180 is similar to the mine roof prop 10 shown in FIGS. 1-6 and described above, except for the differences noted below. In particular, rather than providing the first support plate 32, the mine roof prop 180 may include a secondary yielding arrangement 182. In one embodiment, the secondary yielding arrangement 182 includes a yieldable plate 184 that is secured to a base plate 186. The yieldable plate 184 includes a first concave side 188 and a second, convex side 190 that is secured to the base plate 186 by either fastening members, adhesive, or friction welding, among other methods of connection. The base plate 186 may also have a concave side that faces and engages the convex side 190 of the yieldable plate 184. The yieldable plate 184 is configured to engage a mine roof and deflect and yield upon receiving a predetermined load. In one embodiment, the yieldable plate 184 is configured to yield before the yield member 16. The secondary yielding arrangement 182 may provide additional vertical displacement to increase the amount that the mine roof prop 180 can yield when receiving a predetermined load. The yieldable plate 184 may be a "Yieldable Disk" and the base plate 186 may be a "Piranha Plate", both commercially available from JENNMAR (Pittsburgh, Pa.), although other suitable arrangements may be utilized for the yieldable plate 184 and base plate 186. Alternative arrangements for the secondary yielding arrangement 182 may be provided. For example, the secondary yielding arrangement 182 may include wood header boards, wood cribs, wood wedges, or other similar wood products used underground in mining environments that are each configured to yield upon receiving a predetermined load.

Figure 11A:
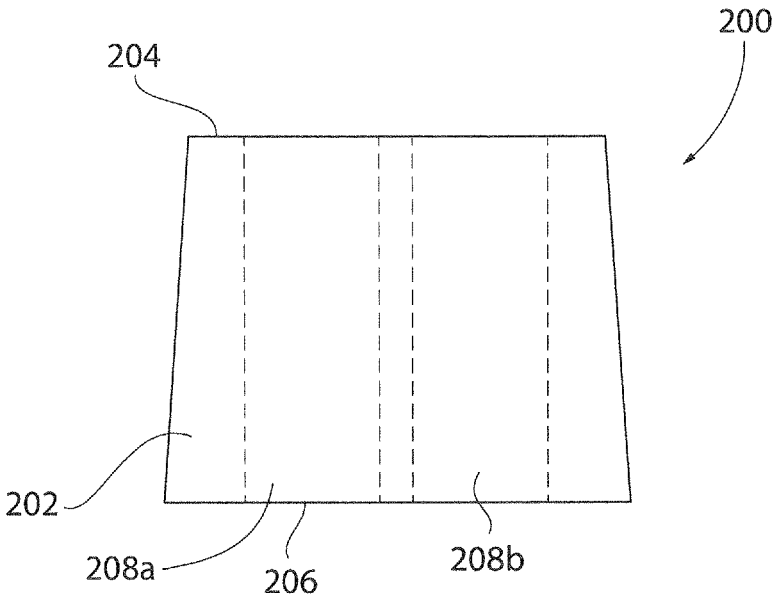
FIG. 11A is a side view of a washer according to one embodiment of the present invention.
Figure 11B:
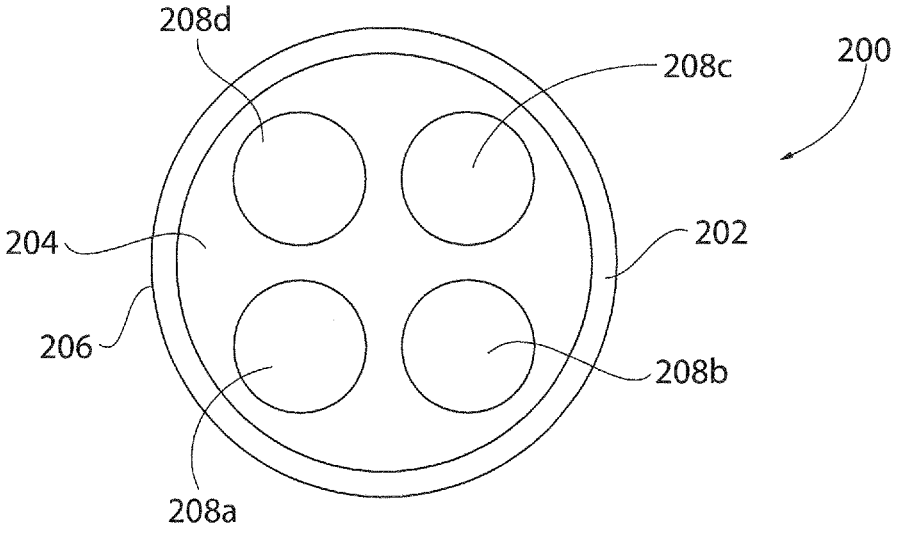
FIG. 11B is a top view of the washer of FIG. 11A.

Referring to FIGS. 11A and 11B, a prop washer 200 may be used in the mine props of the present invention. The washer 200 may be used in place of the washer 166 of the mine roof prop 136 shown in FIG. 9. It is also to be appreciated that the washer 200 may be used in additional types of mine props. For instance, the washer 200 may also be used in place of the washer 72 of the mine prop 70 shown in FIG. 7, in place of the washer 124 of the mine prop 100 shown in FIG. 8, or in place of the yield member 16 of the mine prop 180 shown in FIG. 10. The washer 200 includes a body 202 having a first end 204 and a second end 206. The body 202 defines at least four passageways 208*a*, 208*b*, 208*c*, 208*d* that extend therethrough from the first end 204 to the second end 206 of the body 202. It is to be appreciated, however, that other quantities of passageways may be defined in the body 202, such as 2, 3, 5, or more. The first end 204 of the body 202 of the washer 200 may be secured to the second end 154 of the second pipe 140 (shown in FIG. 9) with the at least four passageways 208*a*, 208*b*, 208*c*, 208*d* in fluid communication with the central passageways 148, 156 of the first and second pipes 138, 140 of FIG. 9. In particular, the washer 200 may be secured to the second pipe 140 via a friction or interference fit, although other suitable securing arrangements may be utilized, such as friction welding, adhesive, or fastening members. By defining at least four passageways 208*a*, 208*b*, 208*c*, 208*d* in the body 202, a greater volume of particulate matter is permitted to flow through the washer 200 upon the second pipe 140 being lifted or moved relative to the first pipe 138, as described hereinabove, due to an increased flow rate of the particulate matter through the body 202. This allows for faster installation of the mine prop 10 in the mining environment 60. The outer diameter of the body 202 of the washer 200 generally matches the outer diameter of the second pipe 140. The outer diameter of the body 202 of the washer 200 may also be slightly tapered to allow for easy installation into the second end 154 of the second pipe 140. The washer 200 may be manufactured from a polymeric material, such as polyvinyl chloride (PVC), to achieve a desired amount of yielding. Further, other types of materials, such as wood or air entrained cements, may be utilized as well. The washer 200, similar to the washer 166 of FIG. 9, has minimized yield characteristics as compared to the yield member 16 of FIG. 1. The washer 200 is stiffer than the yield member 16 and produces a minimal yield under a load. For example, the washer 200 may begin to buckle and fail after 1.5-2 inches of displacement, instead of the 4 inches of displacement experienced by the yield member 16 under a similar load.

While several embodiments were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A mine prop comprising:

a first pipe having a first end and a second end;

a second pipe having a first end and a second end, the second pipe slidably received in the first pipe;

a yield member secured directly to the second pipe such that the yield member moves with the second pipe, the yield member configured to plastically deform before the first and second pipes when the mine prop is placed under a predetermined load.

2. The mine prop of claim 1, wherein the yield member comprises a body having a first end and a second end, the body of the yield member defining at least one passageway extending between the first and second ends of the body.

3. The mine prop of claim 2, wherein the yield member is secured to the second end of the second pipe.

4. The mine prop of claim 3, wherein the first end of the body of the yield member defines an annular recess, the first end of the body of the yield member secured to the second end of the second pipe via a friction fit.

5. The mine prop of claim 4, wherein the annular recess defines a tapered portion on at least a portion of an outer surface of the yield member.

6. The mine prop of claim 2, wherein a washer is secured to the second end of the second pipe, the washer defining an opening, the yield member is secured to the washer with the passageway of the yield member in fluid communication with the opening of the washer.

7. The mine prop of claim 1, wherein the yield member comprises a polymeric material.

8. The mine prop of claim 2, wherein the yield member comprises a polymeric material.

9. The mine prop of claim 1, further comprising particulate material received within the second pipe.

10. The mine prop of claim 2, further comprising particulate material received within the second pipe and the at least one passageway of the yield member, the second pipe having a retracted position and an extended position relative to the first pipe, the particulate material is movable from the second pipe to the first pipe when the second pipe transitions from the retracted position to the extended position.

11. The mine prop of claim 1, further comprising:

a secondary yielding arrangement that is configured to yield prior to the yield member yielding.

12. The mine prop of claim 11, wherein the secondary yielding arrangement comprises a yieldable plate having a concave side facing away from the first end of the second pipe.

13. A method of supporting a mine roof comprising:

positioning a mine prop within a mine opening, the mine prop comprising a first pipe having first and second ends, a second pipe having first and second ends, and a yield member secured directly to the second pipe such that the yield member moves in a same direction as the second pipe, the second pipe received in the first pipe;

extending the second pipe towards a roof of the mine opening; and plastically deforming the yield member when the mine prop receives a predetermined load from the roof of the mine opening.

14. The method of claim 13, wherein the mine prop further comprises particulate material positioned within the second pipe, the particulate material moving from the second pipe to the first pipe when extending the second pipe toward the roof of the mine opening.

15. A mine prop comprising:

a first pipe having a first end and a second end;

a second pipe having a first end and a second end, the second end of the second pipe slidably received in the first pipe such that the second end of the second pipe is surrounded by the first pipe;

a centering pipe received within the first end of the second pipe; and a yield pipe having a first end and a second end, the yield pipe receiving the centering pipe, the second end of the yield pipe engaging the first end of the second pipe, the yield pipe configured to yield before the second pipe when the mine prop is placed under a predetermined load.

16. The mine prop of claim 15, further comprising a washer positioned adjacent the second end of the second pipe, the washer defining an opening.

17. The mine prop of claim 16, further comprising particulate material positioned within the second pipe, the second pipe having a retracted position and an extended position relative to the first pipe, the particulate material is movable from the second pipe to the first pipe when the second pipe transitions from the retracted position to the extended position.

18. The mine prop of claim 15, wherein the yield pipe is axially aligned with the second pipe.

19. The mine prop of claim 15, wherein the yield pipe has a lower compressive strength than a compressive strength of the second pipe.

20. The mine prop of claim 15, further comprising first and second support plates, the first support plate secured to the first end of the yield pipe, the second support plate secured to the second end of the first pipe.

21. A mine prop comprising:

a first pipe having a first end and a second end;

a second pipe having a first end and a second end, the second pipe slidably received in the first pipe;

a washer entirely received and friction fit within the second pipe and defining at least one passageway, the washer comprising a polymeric material; and particulate material positioned within the second pipe, the second pipe having a retracted position and an extended position relative to the first pipe, the particulate material is movable from the second pipe to the first pipe when the second pipe transitions from the retracted position to the extended position.

22. The mine prop of claim 21, wherein the washer comprises polyvinyl chloride.

23. The mine prop of claim 21, wherein the washer is secured to the second pipe via a friction fit.

24. The mine prop of claim 21, wherein the at least one passageway of the washer comprises at least four passageways.

* * * * *